US005136795A

United States Patent [19]

Rosenberg

[11] Patent Number: 5,136,795

[45] Date of Patent: Aug. 11, 1992

[54] SNOW PLOW ASSEMBLY

[76] Inventor: Ivanhoe Rosenberg, 2853 W. Archer Pl., Denver, Colo. 80219

[21] Appl. No.: 815,415

[22] Filed: Dec. 31, 1991

[51] Int. Cl.[5] ..... E01H 5/04

[52] U.S. Cl. ..... 37/233; 37/231; 37/232; 37/235; 37/270; 37/283

[58] Field of Search ..... 37/231, 232, 233, 235, 37/266, 270, 283

[56] References Cited

U.S. PATENT DOCUMENTS

| | | | |
|---|---|---|---|
| 1,709,244 | 4/1929 | Abbe . | |
| 2,061,585 | 11/1936 | Meyer | 37/283 X |
| 2,426,410 | 8/1947 | Owen | 37/283 X |
| 2,614,344 | 10/1952 | Rust . | |
| 4,254,564 | 3/1981 | Rath . | |
| 4,259,794 | 4/1981 | Rath | 37/270 X |
| 4,304,056 | 12/1981 | Watson et al. | 37/231 X |
| 4,307,523 | 12/1981 | Reissinger et al. | 37/233 |
| 4,597,205 | 7/1986 | Guest | 37/266 X |
| 4,635,387 | 1/1987 | Häring | 37/232 |
| 4,794,710 | 1/1989 | Häring | 37/232 |
| 4,813,164 | 3/1989 | Morrell | 37/117.5 |
| 4,821,435 | 4/1989 | Pester | 37/231 |
| 4,821,436 | 4/1989 | Slocum | 37/235 |
| 4,905,387 | 3/1990 | Street | 37/235 X |
| 4,924,610 | 5/1990 | Sodemann | 37/231 |
| 4,962,598 | 10/1990 | Woolhiser | 37/231 |
| 4,976,053 | 12/1990 | Caley | 37/231 |

*Primary Examiner*—Randolph A. Reese
*Assistant Examiner*—J. Russell McBee
*Attorney, Agent, or Firm*—Dorr, Carson, Sloan & Peterson

[57] ABSTRACT

A snow plow assembly has a frame with a rear portion adapted for attachment to a motor vehicle and a blade assembly adapted for rotation about a vertical axis with respect to the front portion of the frame. Two ends of a chain are attached to the blade assembly on either side of the vertical axis. The middle section of the chain can slide in a track (e.g. an arcuate tube) attached to the frame. The yaw angle of the blade is adjustably controlled by sliding the chain with respect to the track. Means are also provided for adjustably securing the chain to the track after the desired angle for the blade has been obtained. In addition, the blade assembly can include means for permitting rotation of said blade about a horizontal axis. In this embodiment, two lever arms extend upward from the blade assembly on opposite sides of the vertical axis. The upper end of each lever arm is attached to one end of the chain. A spring extends from the top of the blade to each arm to exert a force tending to maintain the blade in an upright orientation.

15 Claims, 3 Drawing Sheets

SNOW PLOW ASSEMBLY

BACKGROUND OF THE INVENTION

1. Field of the Invention

The present invention relates generally to the field of snow plows. More specifically, the present invention discloses a snow plow assembly in which a chain sliding in an arcuate guide is used to variably adjust the yaw angle of the blade, and which further has a spring/lever mechanism to enable the lower edge of the blade to roll upward and rearward if the blade strikes an obstruction.

2. Statement of the Problem

The present invention addresses a number of shortcomings heretofore found in snow plows designed for attachment to cars or other types of light vehicles. One problem is the substantial weight of the snow plow which usually dictates the need for some type of hydraulic or electrical system to regulate the angle of the blade. Another problem is the need to provide some means of minimizing damage to the blade if it strikes a curb or some other type of obstruction. In the past, this has sometimes been accomplished by including a deformable link or pin in the frame that is designed to yield if a predetermined force is exceeded. Another approach is to include an hydraulic cylinder that provides a degree of give and resilience in the support frame for the snow plow blade.

A number of snow plows have been invented in the past with various means to adjust the angle of the blade and to prevent damage in the event the blade strikes an obstruction, including the following:

| Inventor | Patent No. | Issue Date |
|---|---|---|
| Sodemann | 4,924,610 | May 15, 1990 |
| Slocum | 4,821,436 | Apr. 18, 1989 |
| Morrell | 4,813,164 | Mar. 21, 1989 |
| Rath | 4,254,564 | Mar. 10, 1981 |
| Rust | 2,614,344 | Oct. 21, 1952 |
| Abbe | 1,709,244 | Apr. 16, 1929 |

Sodemann discloses a snow plow attachment in which the blade is vertically suspended by a cable 7.

Slocum discloses a plow system in which the angle of the blade about a vertical axis (i.e., yaw) is controlled by two sets of cables 68A and 68B through a winch 66 and pulley arrangement 67A, 69A, 67B, and 69B.

Morrell discloses an apparatus for mounting a snow plow 12 to the bucket 14 of a conventional frontend loader. The chains 34*a* and 34*b* extending from the snow plow frame 32 to the grab hooks 52 on the top edge of the bucket for raising and lowering the blade.

Rath discloses a reversible snow plow attachment in which a cable 14 is used to suspend the snow plow blade from an arm 13. Elevation of the blade is controlled by a hydraulic cylinder 12 that can raise or lower the arm 13. The angle of the blade with respect to its vertical pivotal axis is controlled to two hydraulic cylinders 26 and 27.

Rust discloses an arrangement in which a chain 61, 62 is used to adjustably control the elevation of a blade mounted to the front of a motor vehicle.

Abbe discloses another example of a device in which chains 8 and 12 are used to lift a snow plow blade attached to the front of a motor vehicle.

3. Solution to the Problem

None of the prior art references uncovered in the search show a snow plow assembly having the structural combination of the present invention. In particular, none of the prior art references teach or suggest the combination of a chain and arcuate track to control the yaw angle of the blade, together with a spring/lever mechanism to allow a small degree of forward roll of the blade to overcome obstructions.

SUMMARY OF THE INVENTION

This invention provides a snow plow assembly having a frame with a rear portion adapted for attachment to a motor vehicle and a blade assembly adapted for rotation about a vertical axis with respect to the front portion of the frame. Two ends of a chain are attached to the blade assembly on either side of the vertical axis. The middle section of the chain can slide in a track (e.g. an arcuate tube) attached to the frame. The yaw angle of the blade is adjustably controlled by sliding the chain with respect to the track. Means are also provided for adjustably securing the chain to the track after the desired angle for the blade has been obtained. In addition, the blade assembly can include means for permitting rotation of said blade about a horizontal axis. In this embodiment, two lever arms extend upward from the blade assembly on opposite sides of the vertical axis. The upper end of each lever arm is attached to one end of the chain. A spring extends from the top of the blade to each arm to exert a force tending to maintain the blade in an upright orientation.

A primary object of the present invention is to provide a snow plow that can be readily attached to a conventional automobile or light truck, and which does not require an hydraulic cylinder or electric motor for operation.

Another object of the present invention is to provide a snow plow having minimal complexity that can be manufactured at low cost and that can be readily understood and used by members of the public without extensive training.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
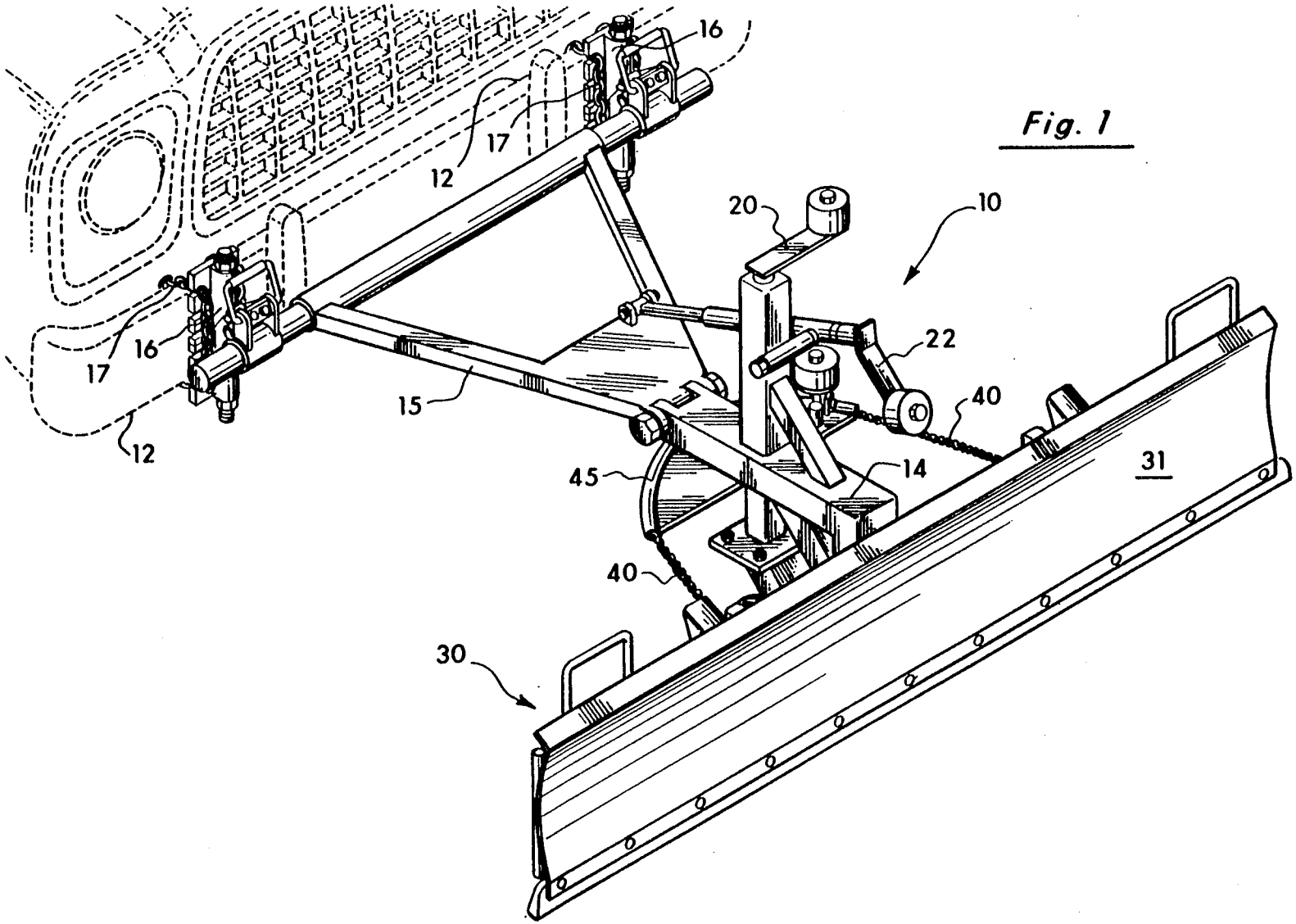
FIG. 1 is a front perspective view of the snow plow assembly.
Figure 2:
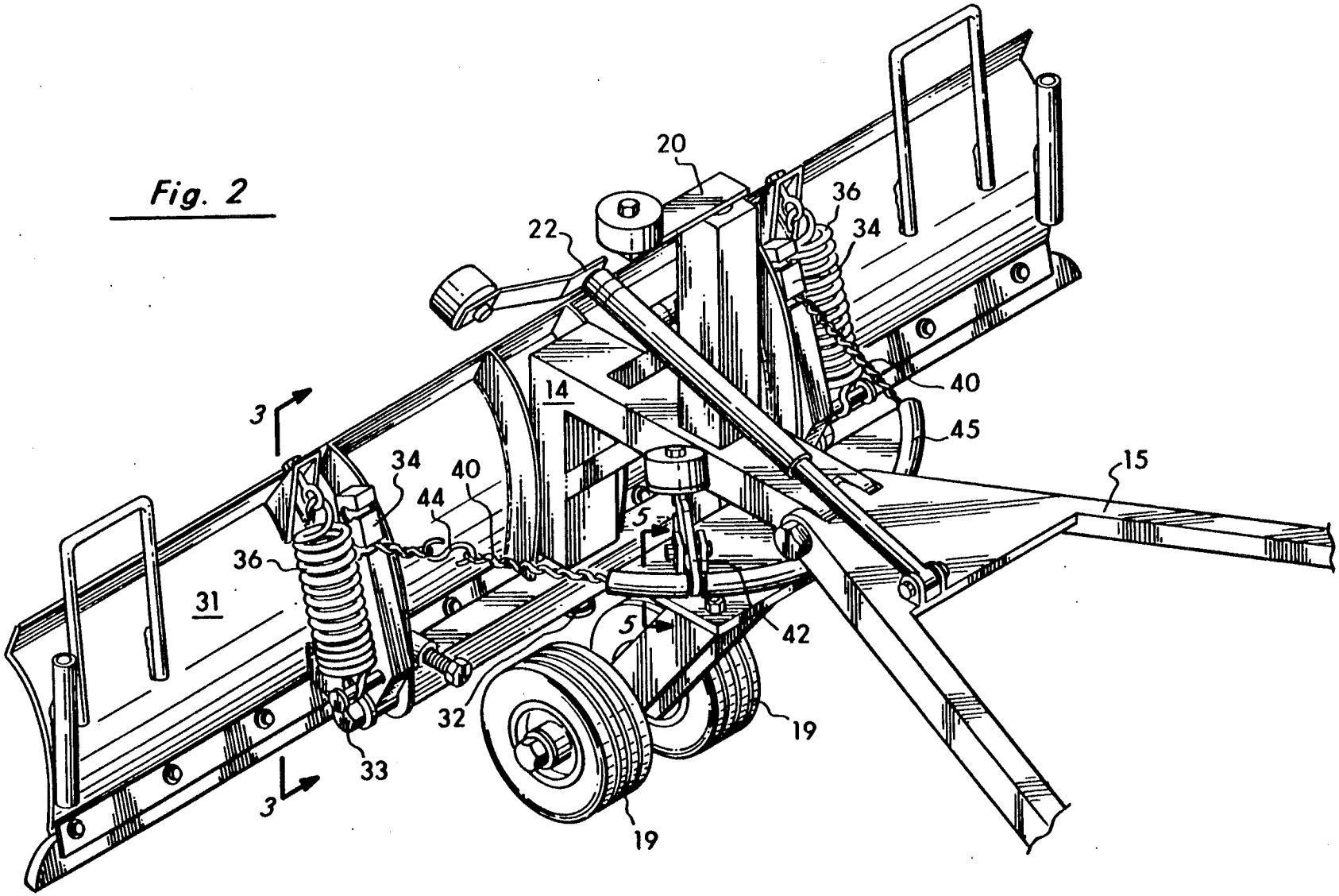
FIG. 2 is a rear perspective view of the snow plow assembly.

Turning to FIG. 1., a front perspective view is provided of the snow plow assembly 10 attached to the front bumper of a vehicle 12. A corresponding rear perspective view is shown in FIG. 2.

In the preferred embodiment, the frame of the snow plow assembly has a substantially triangular rear portion 15 with two bumper pads 16 that are removably secured to the front of the vehicle bumper by means of chains 17 looped around behind the bumper. Two links in each chain 17 are inserted into corresponding slots in the bumper pads 16 to hold the bumper pads snugly in place against the front of the vehicle bumper.

The front portion 14 of the frame is connected to the rear portion 15 by means of a horizontal hinge. A threaded shaft and crank assembly 22 allows adjustment of the angle formed between the front portion 14 and the rear portion 15 of the frame to accommodate differences in the height of the vehicle bumper.

One or more wheels 19 located behind the blade assembly 30 are used to provide vertical support for the front portion 14 of the frame and the blade assembly 30. Each wheel 19 is allowed to freely pivot about a vertical axis so that the direction of movement of the snow plow assembly 10 can be easily controlled by steering the vehicle 12. A second threaded shaft and crank assembly 20 allows adjustment of the elevation of the front portion 14 of the frame and the blade assembly 30 with respect to the wheels 19.

Figure 5:
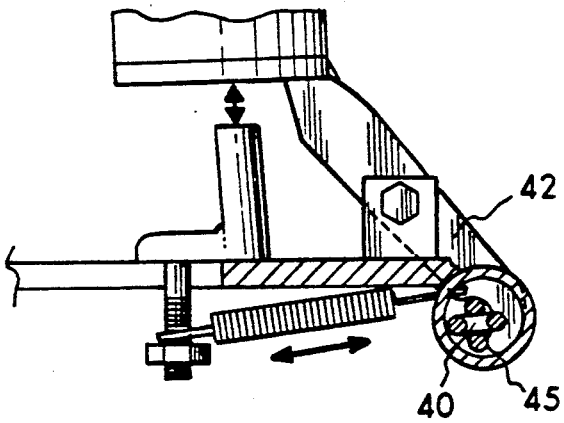
FIG. 5 is a side view of the latch mechanism showing the arcuate tube and chain in cross-section.

The blade assembly 30 is attached to the front of the front portion 14 of the frame as shown in FIGS. 1 and 2 by a hinge assembly that permits rotation of the blade 31 about a vertical axis 32 to adjust the yaw angle of the blade 31. The yaw angle is adjustably controlled by a length of chain 40 having two ends attached to the blade assembly 30 on opposite sides of the vertical axis 32. The mid-section of the chain 40 slides along a track 45 secured to the front portion 14 of the frame. During adjustment of the yaw angle of the blade assembly 30, the mid-section of the chain 40 freely slides with respect to the track. In the preferred embodiment, this track 45 is an arcuate tube as shown in FIGS. 1 and 2 having an inside diameter large than the cross-sectional dimensions of the chain 40 to permit the chain to slide freely through the arcuate tube. Alternatively, a length of cable or some other flexible elongated member could be substituted in place of the chain 40. After the blade 31 has been manually positioned in the desired yaw angle, a latch mechanism 42 prevents further movement of chain with respect to the track 45. In the preferred embodiment, the latch mechanism 42 is a spring-loaded pin that can be removably inserted through a corresponding opening in the track 45 to block any substantial sliding movement of the chain links within the track as shown in FIG. 5.

Figure 3:
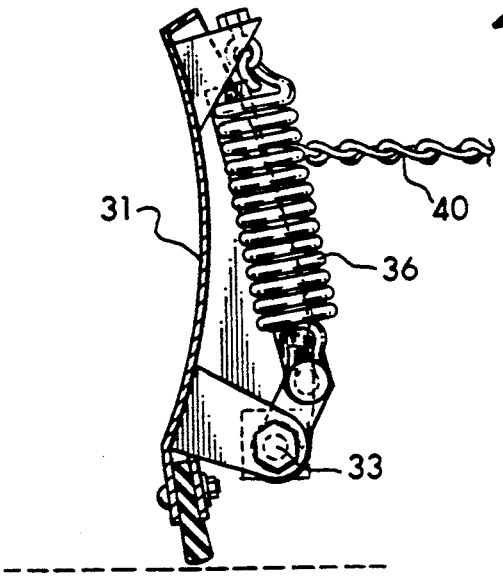
FIG. 3 is a side elevational view of the blade, spring, and lever arm.
Figure 4:
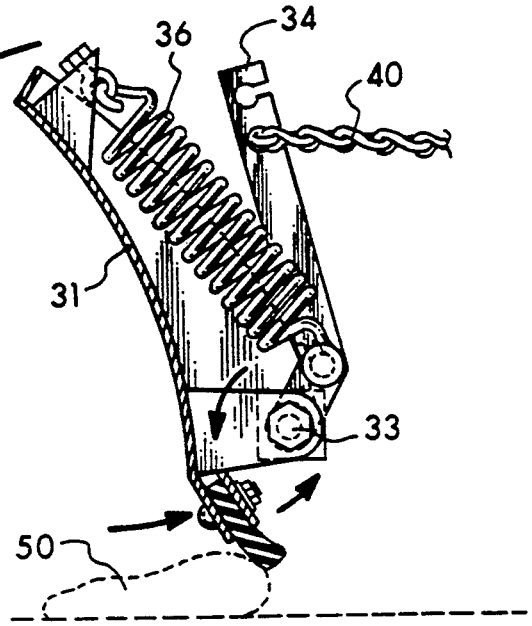
FIG. 4 is a side elevation view corresponding to FIG. 3 showing the manner in which the lower edge of the blade rotates rearward and upward if it hits an obstruction.

In addition to rotation about the vertical axis 32, a spring / lever arm mechanism allows the blade 31 to roll a limited degree about a horizontal axis 33 extending along the rear of the blade assembly 30. This feature is intended to permit the lower edge of the blade 31 to rotate out of the way, in an upward and rearward direction as shown in FIGS. 3 and 4, in the event the blade strikes an obstruction 50. The upper edge of the blade also rolls forward and downward, thereby tilting forward the angle of inclination of the blade 31 about the horizontal axis 33. This forward tilt tends to cause the blade 31 to slide up and over the obstruction 50.

Two lever arms 34 extend generally upward from the horizontal axis 33 on opposite sides of the vertical axis 32. Each end of the chain 40 is secured to the upper section of one of these lever arms 34. Two springs 36 are fastened between the upper edge of the blade 31 and each of the lever arms 34. In the event the blade 31 strikes an obstruction 50, forward rotation of the upper portion of the blade 31 temporarily lengthens the springs 36 resulting in a tensile force which tends to return the blade 31 to its upright position after the obstruction has been passed.

A deformable link 44 can be included in the chain 40 as shown in FIG. 2 as an added safety feature. The deformable link is designed to yield at a predetermined stress level and thereby break the chain 40 if an unusually large stress is placed on the blade 31, e.g. if the end of the blade 31 strikes a curb. This allows the blade to rotate about the vertical axis 32 to its most extreme yaw angle to swing out of the way of the obstruction and minimize further damage to the blade 31.

The above disclosure sets forth the preferred embodiment of the present invention. Other arrangements or embodiments, not precisely set forth, could be practiced under the teachings of the present invention and as set forth in the following claims.

I claim:

1. A snow plow assembly for attachment to a motor vehicle, comprising:

a frame having a front portion and a rear portion adapted for attachment to said motor vehicle;

a substantially horizontal blade assembly adapted for rotation about a predetermined vertical axis with respect to said front portion of said frame;

an elongated flexible member having two ends attached to said blade assembly on either side of said vertical axis;

a track attached to said frame adapted for sliding engagement with said flexible member;

means for adjustably securing said flexible member to said track.

2. The snow plow assembly of claim 1 further comprising at least one wheel supporting said frame.

3. The snow plow assembly of claim 2 further comprising means for adjustably controlling the elevation of said frame with respect to said wheel.

4. The snow plow assembly of claim 1 wherein said flexible member comprises a chain.

5. The snow plow assembly of claim 1 wherein said track comprises an arcuate tube.

6. The snow plow assembly of claim 5 wherein said means for adjustably securing said flexible member comprise a pin removably secured in an opening through said arcuate tube.

7. A snow plow assembly for attachment to a motor vehicle, comprising:

a frame having a front portion and a rear portion adapted for attachment to said motor vehicle;

a blade assembly adapted for rotation about a predetermined vertical axis with respect to said front portion of said frame, said blade assembly having:

(a) a substantially horizontal blade;

(b) means for permitting rotation of said blade about a predetermined horizontal axis; and (c) two upwardly extending arms on opposite sides of said vertical axis;

at least one spring extending from said blade to one of said arms, adapted to exert a force tending to maintain said blade in a predetermined orientation about said horizontal axis;

an elongated flexible member having two ends, with each end being attached to one of said arms;

a track attached to said frame adapted for sliding engagement with said flexible member; and means for adjustably securing said flexible member to said track.

8. The snow plow assembly of claim 7 further comprising at least one wheel supporting said frame.

9. The snow plow assembly of claim 8 further comprising means for adjustably controlling the elevation of said frame with respect to said wheel.

10. The snow plow assembly of claim 7 wherein said flexible member comprises a chain.

11. The snow plow assembly of claim 7 wherein said track comprises an arcuate tube having an inside diameter larger than the maximum cross-sectional dimension of said flexible member.

12. The snow plow assembly of claim 11 wherein said means for adjustably securing said flexible member comprise a pin removably secured in an opening through said arcuate tube.

13. A snow plow assembly for attachment to a motor vehicle, comprising:

a frame having a front portion and a rear portion adapted for attachment to said motor vehicle;

at least one wheel supporting said frame;

a blade assembly adapted for rotation about a predetermined vertical axis with respect to said front portion of said frame, said blade assembly having:

(a) a substantially horizontal blade;

(b) means for permitting rotation of said blade about a predetermined horizontal axis; and (c) two lever arms on opposite sides of said vertical axis upwardly extending from said horizontal axis;

at least one spring extending from said blade to one of said arms, said spring being adapted to exert a force tending to maintain said blade in a predetermined orientation;

a chain having two ends, with each end of said chain being attached to one of said arms;

an arcuate tube attached to said frame adapted for sliding engagement with said chain; and means for adjustably securing said chain with respect to said arcuate tube.

14. The snow plow assembly of claim 13 further comprising means for adjustably controlling the elevation of said frame with respect to said wheel.

15. The snow plow assembly of claim 13 wherein said means for adjustably securing said chain comprise a pin removably secured in an opening through said arcuate tube.

* * * * *